US006977593B2

(12) United States Patent
Schmedemann et al.

(10) Patent No.: US 6,977,593 B2
(45) Date of Patent: Dec. 20, 2005

(54) METHOD FOR ASSURING SAFETY DURING FIRING EXERCISES WITH LIVE AMMUNITION

(75) Inventors: Hellmuth Schmedemann, Walsrode (DE); Manfred Junge, Schwanewede (DE)

(73) Assignee: STN ATLAS Elektronik GmbH, Bremen (DE)

( * ) Notice: Subject to any disclaimer, the term of this patent is extended or adjusted under 35 U.S.C. 154(b) by 398 days.

(21) Appl. No.: 10/317,142

(22) Filed: Dec. 12, 2002

(65) Prior Publication Data

US 2004/0005532 A1 Jan. 8, 2004

(30) Foreign Application Priority Data

Dec. 12, 2001 (DE) ..... 101 60 946

(51) Int. Cl.[7] ..... G08B 21/00

(52) U.S. Cl. ..... 340/686.1; 89/1.1; 340/5.5; 342/67; 434/11

(58) Field of Search ..... 340/686.1, 540, 340/573.1, 5.2, 5.5, 539.13, 539.16, 539.17; 434/11, 16, 19, 27; 89/1.1, 41.18; 342/450, 342/67

(56) References Cited

U.S. PATENT DOCUMENTS 5,822,713 A * 10/1998 Profeta ..... 342/67

FOREIGN PATENT DOCUMENTS

| | | | | |
|---|---|---|---|---|
| DE | 25 55 020 A | | 6/1977 | |
| DE | 40 26 207 A1 | | 2/1992 | |
| DE | 199 15 222 A | | 10/2000 | |
| FR | 2 712 675 | | 5/1995 | |
| GB | 2080502 A | * | 2/1982 | ..... F41G 11/00 |

OTHER PUBLICATIONS

Patent Abstracts of Japan, vol. 1995, No. 9, Oct. 31, 1995, JP 07 146096 A (Fujitsu Ltd.) Jun. 6, 1995.

* cited by examiner

*Primary Examiner*—Thomas Mullen
(74) *Attorney, Agent, or Firm*—Venable LLP; Michael A. Sartori; Stuart I. Smith

(57) ABSTRACT

A method for assuring safety during firing exercises with live ammunition by mobile skirmish participants (11, 11') practicing under combat conditions in an enclosed practice range (10) that is monitored from a monitoring center (14), to protect all participants (11, 11') from being shot by firing participants (11). The instantaneous positions of the participants (11, 11') are continuously determined, and transmitted to a monitoring center (14) wherein the transmitted positions and movement regions derived therefrom for all participants (11, 11'), and the positions of stationary objects (13) that are present, are used to calculate current, authorized firing sectors (38) for the firing participants (11) and are individually transmitted to the firing participants (11). For each firing participant (11), the instantaneous weapon setting (39) is compared to the assigned firing sectors (38), and firing authorization is only given if the instantaneous weapon setting (39) lies within these firing sectors (38).

16 Claims, 3 Drawing Sheets

METHOD FOR ASSURING SAFETY DURING FIRING EXERCISES WITH LIVE AMMUNITION

CROSS-REFERENCE TO RELATED APPLICATION

This application is based on and claims the priority date of German Application No. 101 60 946.9 filed on Dec. 12, 2001, which is incorporated herein by reference.

BACKGROUND OF THE INVENTION

The invention relates to a method for assuring safety during firing exercises with live ammunition by mobile skirmish participants practicing under combat conditions in an enclosed practice range that is monitored from a monitoring center.

Firing exercises at military practice ranges with weapons systems that were designed for mobile use, such as combat tanks, armored personnel carriers and the like, require the skirmish participants to have unlimited movement and fighting capability in large spaces in order to simulate a dangerous combat situation with the associated weapons, unlike in the fixed firing ranges in a practice range, as have been used conventionally. In this utilization of the practice range, external and internal safety must be assured. That is, appropriate measures must be taken to reliably prevent the firing skirmish participants from firing shots outside of the practice-range boundary (external safety), and to prevent them from firing into regions of the practice range in which other firing and non-firing skirmish participants and stationary objects to be protected are located (internal safety).

In a known method, special safety personnel are assigned to each firing skirmish participant to assure safety during firing exercises. These personnel are in radiotelephone contact with the monitoring center, and issue the firing order to the skirmish participant on-site.

SUMMARY OF THE INVENTION

It is the object of the invention to provide a method for assuring safety during firing exercises, which meets the high safety requirements for military practice ranges while permitting a significant reduction in safety personnel, and allows for unimpeded mobility of all skirmish participants within the practice range as the firing skirmish participants practice with live ammunition.

The above object generally is achieved according to the present invention by a method for assuring safety during firing exercises with live ammunition by mobile skirmish participants practicing under combat conditions in an enclosed practice range that is monitored from a monitoring center, with the method comprising: continuously determining the instantaneous positions of the skirmish participants; transmitting the determined instantaneous positions to the monitoring center; in the monitoring center, using the transmitted instantaneous positions and movement regions that can be derived therefrom for all skirmish participants to calculate current, authorized firing sectors for the firing skirmish participants, taking into account the boundary of the practice range; individually transmitting the authorized firing sectors to the respective firing skirmish participants; and for each firing skirmish participant, comparing the instantaneous weapon setting to the respective authorized firing sectors; and providing a firing authorization for a firing sector only if the respective instantaneous weapon setting lies within the authorized firing sector.

The method according to the invention for assuring firing safety during firing exercises has the advantage of creating gap-free, reliable protection of all skirmish participants against shooting injuries by firing skirmish participants during firing exercises at an open range with moving weapons systems. This protection is assured in any combat situation, regardless of the position, or travel direction or speed of the skirmish participants. It is further ensured that no firing skirmish participants can shoot beyond the boundaries of the practice range, and that stationary objects located within the range are protected against damage due to unauthorized firing. An authorized firing sector is defined as a spatial expansion in the practice range in which an individual firing skirmish participant can fire without posing a threat to other skirmish participants, or to stationary objects that may be located in the practice range and must be protected from shooting.

Further advantageous embodiments and modifications of the method according to the invention are described.

In accordance with a preferred embodiment of the invention, a danger zone is taken into consideration, either in the monitoring center in the calculation of the current, authorized firing sectors for the firing skirmish participants, or in the comparison of the weapon setting to the transmitted, current firing sectors for each skirmish participant. This danger zone is defined as a spatial expansion in the practice range for each weapon of a firing skirmish participant, and takes into account the weapon type and the type of ammunition to be fired with the weapon. In the first case, the boundary of the authorized firing sector is reduced by this danger zone. In the second case, firing is only authorized if the danger zone also lies within the firing sector for the instantaneous weapon setting.

In accordance with an advantageous feature of the invention, so-called system tolerances are also factored into the calculation of the danger zone. These system tolerances are, among other things, error tolerances that may occur in the determination of the position and the detection of the weapon setting.

In accordance with an advantageous embodiment of the invention, the positions of stationary objects within the practice range that must be protected are also incorporated into the calculation of the authorized firing sectors, so the objects are also protected against shooting.

In accordance with a further advantageous embodiment of the invention, the positions of the skirmish participants are assigned the times when they are determined, and the defined firing sectors are assigned the times when they are determined, as well as a validity period. For the firing skirmish participants, their instantaneous weapon setting is only compared to the assigned firing sectors if the time when the weapon setting is determined lies within the validity period. Consequently, the determination of the skirmish participants' positions, the calculation of the firing sectors and the verification of the weapon settings of the skirmish participants are effected on a common time basis and in a defined temporal cycle, so it is possible to ascertain which current validity of firing sectors and weapon settings also takes into account the movements of the skirmish participants.

The invention is described in detail below by way of an exemplary embodiment of a firing-safety device illustrated in the drawing.

DESCIPTION OF THE PREFERRED EMBODIMENTS

Figure 1:
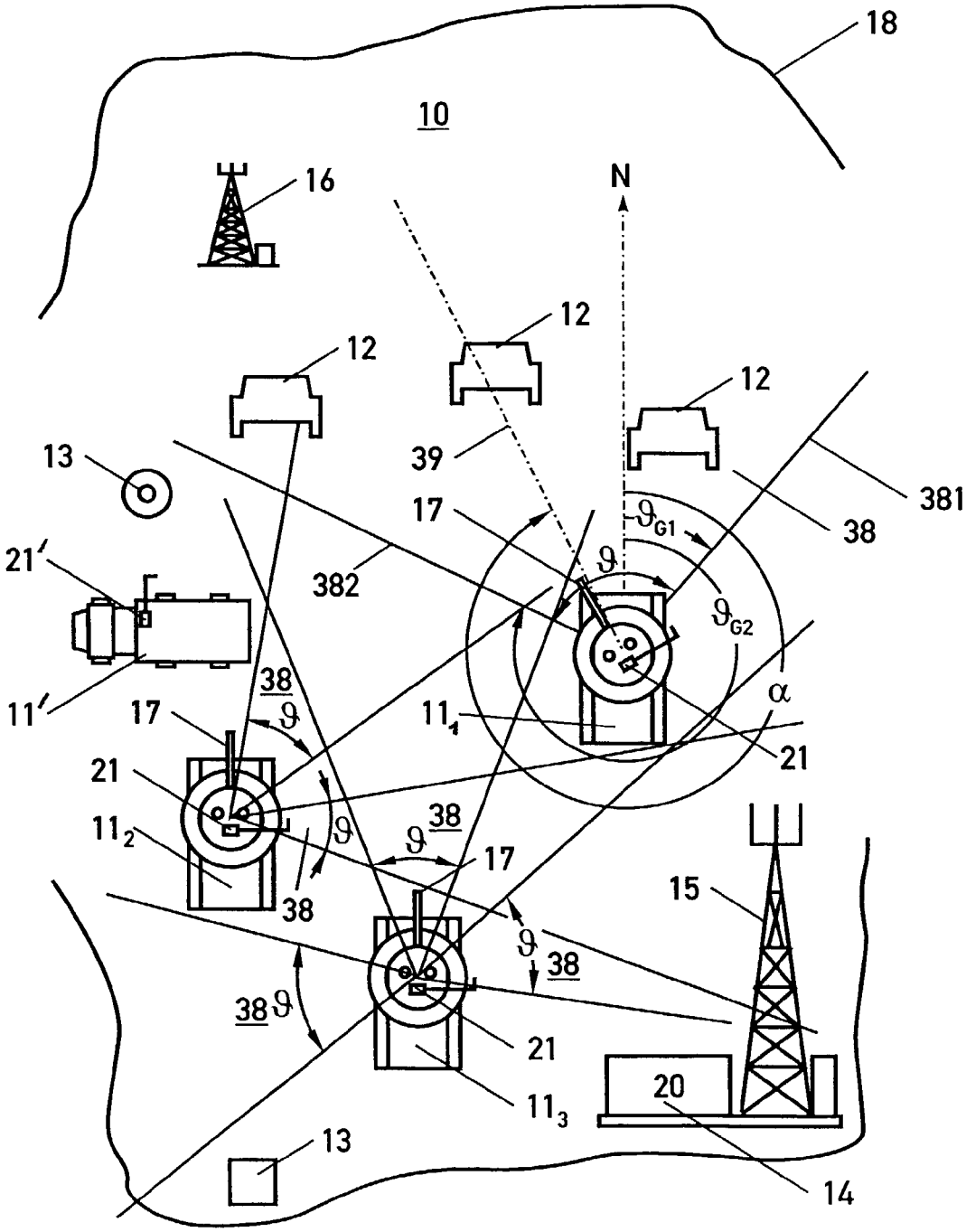
FIG. 1 is a schematic plan view of a combat scenario in a practice range, which shows skirmish participants, stationary objects and authorized firing sectors that have been defined for the firing skirmish participants.

FIG. 1 is a cut-out illustration of a practice range 10 that is bordered by a boundary line 18, and in which mobile skirmish participants 11 practice under combat conditions, using live ammunition. In the illustrated embodiment, the firing skirmish participants 11 are combat tanks of a military unit that fire live rounds with their weapons 17, in this case tank guns, at targets 12 set up in the practice range 10. In addition to or instead of the combat tanks, however, other types of firing skirmish participants 11, such as guns, rocket launchers, anti-tank helicopters or the like, may be present. As an example of non-firing skirmish participants 11' that also participate in the combat exercises by moving in the practice range 10, FIG. 1 illustrates a vehicle, e.g., the unit logistics. Further mobile, non-firing skirmish participants 11' can also be instructional and/or observational vehicles. Also located in the practice range 10 are individual stationary objects 13, which must not come under fire by the firing skirmish participants 11.

The combat exercises are observed by appropriate monitoring personnel in a stationary monitoring center 14, and may be conducted from there. The monitoring center 14 and the skirmish participants 11, 11' are in data radio contact with one another. For this purpose, a primary radio station 15 is set up at the monitoring center 14, and relay stations 16 are distributed throughout the practice range 10 to assure a gap-free radio connection over the entire practice range 10.

During firing exercises, it is necessary to protect all skirmish participants 11, 11' within the practice range 10 from being shot, as well as to prevent the firing skirmish participants 11 from firing past the boundary line 18 of the practice range 10. To assure this so-called internal and external safety during firing exercises, a safety apparatus is installed in the practice range 10 for firing exercises. This safety apparatus includes a monitoring device 20 (FIG. 2), which is disposed in the monitoring center 14, and a plurality of safety devices 21 (See FIG. 3), one of which is provided on each firing skirmish participant 11. The monitoring device 20 and the safety devices 21 on the firing skirmish participants 11 are connected to one another via a data radio connection, and exchange relevant data via this connection for assuring safety during firing exercises. The non-firing skirmish participants 11' are equipped with a safety device 21' including at least a position sensor and a data radio transmitter of a safety device 21, so that the non-firing skirmish participant 11 can transmit its position and, if needed, other data acquired on-site to the monitoring device 20.

Figure 2:
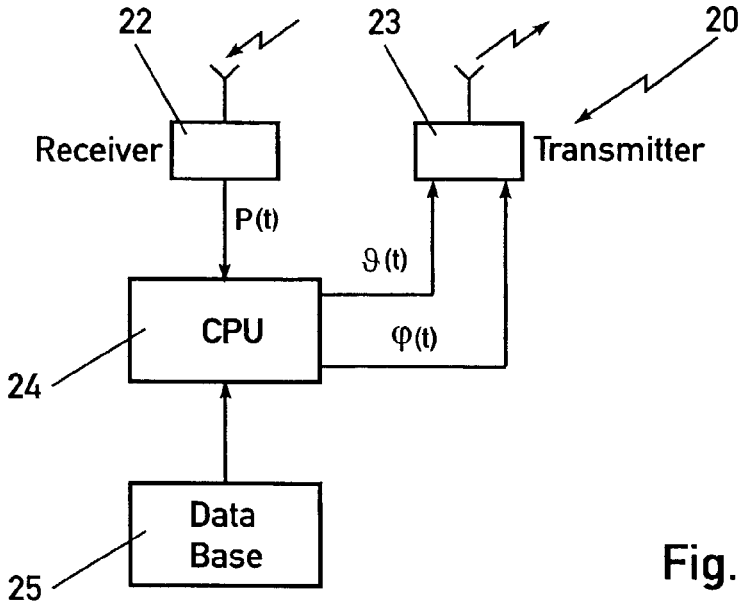
FIG. 2 is a block diagram of a monitoring device that is integrated into a monitoring center as a component of the firing-safety device.

FIG. 2 is a block diagram of the components of the monitoring device 20. The monitoring device 20 includes a radio receiver 22 and a radio transmitter 23, a central computer 24 and a database 25 that stores the cartographically-recorded practice range 10 with the boundary line 18 and the positions of the stationary objects 13 to be protected. In the central computer 24, the data received via the radio receiver 22 from the skirmish participants 11 11', that is, from the firing and non-firing skirmish participants are processed to assess the participants' positions, and are transmitted as preset data to the radio transmitter 23, which transmits them, encoded for the individual firing skirmish participants 11, 11' into the practice range 10.

Figure 3:
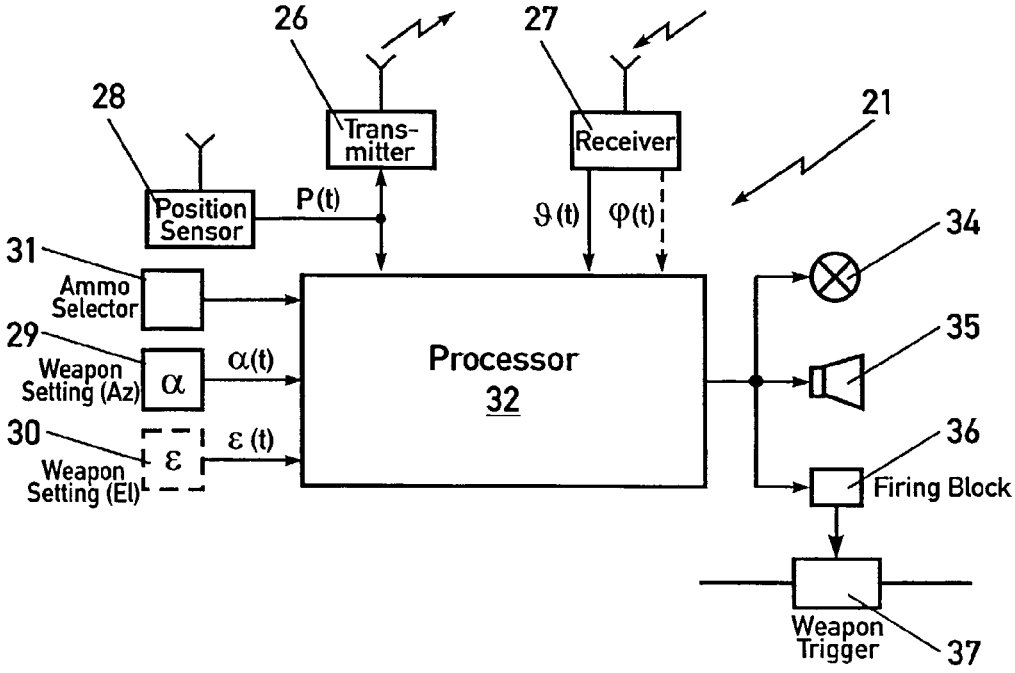
FIG. 3 is a block diagram of a safety apparatus that is provided on each firing participant as a component of the firing-safety device.

FIG. 3 is a block diagram of the components for a safety device 21 provided on each firing skirmish participant 11. The safety device 21 has a radio transmitter 26, a radio receiver 27, a position sensor 28 for determining the instantaneous position P(t) of the firing skirmish participant 11, a weapon-setting sensor 29 for detecting the pivot-angle position $\alpha(t)$ of the weapon in azimuth, possibly a weapon-setting sensor 30 for detecting the weapon setting $\epsilon(t)$ in elevation, an ammunition-selection switch 31, which is used to select the type of ammunition to be fired with the weapon 17, and a visual and an acoustic display element 34, 35, respectively, which signal a firing authorization to the firing skirmish participant 11. Additionally, a firing block 36 can be provided in the safety device 21. This firing block 36 blocks the manual initiation of a shot by a weapon trigger 37. The processor 32, which switches on the visual and acoustical display elements 34 and 35 for identifying the firing authorization, deactivates the firing block 36 when the firing authorization has been given, so the weapon 17 can be fired with the weapon trigger 37.

Each non-firing skirmish participant 11' is equipped or provided with a safety device 21' (FIG. 1), which has a greatly reduced number of components. Specifically, although not shown here, the safety device 21' only comprises the radio transmitter 26 and the position sensor 28 for determining the instantaneous position P(t). The positions of the non-firing skirmish participant 11' as ascertained by the position sensor 28, like the positions of the firing skirmish participants 11, are transmitted in intervals from the radio transmitter 26 to the monitoring center 14. In the described example, the determination of position by the position sensor 28 is based on the Global Positioning System (GPS), as is the case for the firing skirmish participant 11. Of course, alternative methods for determining position are also feasible.

The method assures firing safety with the following components: the monitoring device 20, with its components that are installed in the monitoring center 14; the safety devices 21, with their components that are provided on the individual firing skirmish participants 11; and the safety devices 21', with the components of radio transmitter 26 and position sensor 28 that are provided on the non-firing skirmish participants 11'.

Each position sensor 28 continuously determines the respective instantaneous position P(t) of the respective firing skirmish participant 11 or non-firing skirmish participant 11', and transmits the determined position via the radio transmitter 26 to the monitoring center 14. The position P(t) is determined in intervals, with each position P being assigned the time t when it was determined. The length of the interval between the position indications for the skirmish participants 11, 11' depends on their speed, and shortens as the speed increases and the distance from the other skirmish participants 11, 11' decreases. In the monitoring center 14, all of the positions of the skirmish participants 11, 11' that have been ascertained in this manner are stored in the position map of the practice range 10, which is made available by the database 25. In the central computer 24, the position of each respective firing skirmish participant 11', the positions of all other skirmish participants 11, 11', the positions of the stationary objects 13, the possible areas of movement of all skirmish participants 11 and the boundary line 18 of the practice range 10 are taken into consideration in calculating permissible firing sectors 38 (FIG. 1), in which the respective firing skirmish participant 11 assigned these sectors 38 may fire within the practice range 10 outlined by the boundary line 18. These authorized firing sectors 28 are transmitted individually to the firing skirmish participants 11 via the data radio connection. The calculated authorized firing sectors 38 can additionally be subjected to a plausibility check, and may be excluded from a transmission to the firing skirmish participants 11. The reasons for such exclusions include the absence of targets 12 in the respective firing sector 38, or they may be didactic or tactical in nature. The time when the authorized firing sectors 38 were calculated, as well as a validity period, are assigned to the sectors for the transmission to the firing skirmish participants 11, so each data transmission via the radio transmitter 23 to the firing skirmish participants 11 includes the coordinates of the firing sectors 38, the time of their calculation and the validity period.

FIG. 1 is a schematic representation of the authorized firing sectors 38 that the monitoring device 20 has calculated for the three firing skirmish participants 11, the sectors being assigned to the individual firing skirmish participants 11. Only one authorized firing sector 38 was indicated for the firing skirmish participant $\mathbf{11}_1$ shown at the top in FIG. 1. Two firing sectors 38 were authorized for the firing skirmish participant $\mathbf{11}_2$ shown on the left in FIG. 1, while three possible firing sectors 38 were established for the lower firing skirmish participant $\mathbf{11}_3$ in FIG. 1. Each firing sector 38 is defined, for example, by an azimuth angle $\Theta$, which relates to the individual position of the respective firing skirmish participant 11. The azimuth angle $\Theta$ is defined by, for example, a north-referenced, lower angular boundary $\Theta_{G1}$, and a north, upper angular boundary $\Theta G_2$, as shown in FIG. 1 for the firing sector 38 of the upper firing skirmish participant $\mathbf{11}_1$.

The radio receiver 27 of the firing skirmish participant 11 addressed by the code receives the encoded data transmissions that are transmitted by the radio transmitter 23, and contain the established firing sectors 38 for the time t and their validity period, such as the angular boundaries $\Theta_{G1}(t)$ and $\Theta_{G2}(t)$. The receiver 27 decodes the transmissions and supplies them to the respective processor 32. In the processor 32, it is determined whether the instantaneous weapon setting 39 of the weapon 17 of the firing skirmish participant $\mathbf{11}_1$ which, in the illustrated embodiment, is supplied to the processor 32 in the form of the azimuth pivoting angle $\alpha(t)$ of the weapon 17, matches the assigned firing sectors 38 relative to time, that is, whether the time when the weapon setting is determined lies within the validity period of the assigned firing sectors 38. If this is the case, it is determined in the processor 32 whether the instantaneous weapon setting 39 of the firing skirmish participant lies within one of the firing sectors 38 assigned to the skirmish participant. Otherwise, i.e., if the validity period of one or more firing sectors 38 does not include the time of the determination of the weapon setting, or does not cover or extend beyond it, the sector(s) 38 is (are) eliminated and not considered further. If the instantaneous weapon setting 39 lies within a firing sector 38, the firing skirmish participant 11 is authorized to fire in this firing sector, and the processor 32 generates a firing-authorization signal that activates the visual display element 34 and/or the acoustic display element 35 for signaling the firing authorization, and possibly deactivates the firing block 36 for the weapon trigger 37. With the instantaneous weapon setting 39, the firing skirmish participant 11 is allowed to fire a shot at the target 12 in its sights.

For clarifying this process, FIG. 1 shows the north-referenced angular boundaries $\Theta_{G1}$ and $\Theta_{G2}$ of the azimuth angle $\Theta$ of a firing sector 38, delimited by lines 381 and 382, that has been authorized for the upper, firing skirmish participant $\mathbf{11}_1$, the angles being, for example, 40° and 295°, respectively. The north-referenced, azimuthal pivot angle a of the weapon 17 is, for example, 333°. In this instance, the pivot angle $\alpha$ lies between the upper angular boundary $\Theta_{G2}$ and the lower angular boundary $\Theta_{G1}$. The instantaneous weapon setting 39 thus lies inside the firing sector 38. If the firing skirmish participant 11 does not alter its position, it can combat all three targets 12 located within this authorized firing sector 38 bounded by lines 381 and 382. If the skirmish participant aims the weapon 17 at the target 12 to the right in FIG. 1, the north, azimuthal pivot angle $\alpha$ of the weapon 17 decreases dramatically, but is still located within the angular boundaries $\Theta_{G1}$ and $\Theta_{G2}$ of this firing sector 38, so the condition for the firing authorization is also met for this pivot position of the weapon 17.

Figure 4:
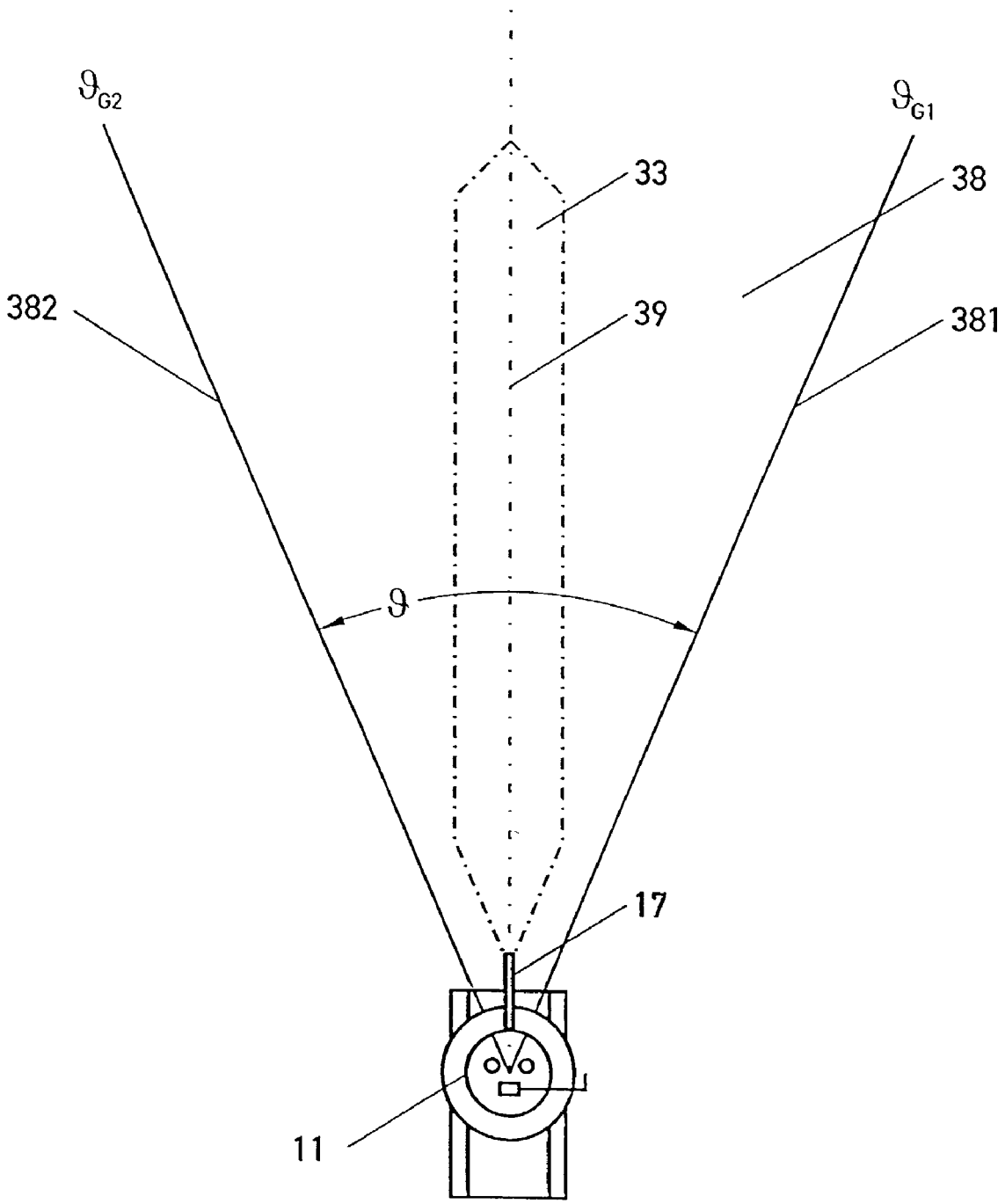
FIG. 4 is a schematic plan view of a firing sector with a danger zone, the sector being allocated to a firing skirmish participant.

Because it cannot normally be assumed that the shot fired with the instantaneous weapon setting 39 of the firing skirmish participant 11 moves in the vertical plane through which the bore axis of the weapon 17 passes, but deviates more or less laterally from it, a danger zone 33 (See FIG. 4) for the weapon type of the skirmish participant 11 and the type of ammunition fired with this weapon type is established as a spatial expansion in the practice range 10. FIG. 4 illustrates this danger zone 33 by way of example. The geometric shape of the danger zone can vary greatly, depending on the type of weapon and ammunition. The established danger zone 33 is taken into consideration in the comparison of the instantaneous weapon setting 39 to the authorized firing sectors 38. Namely, it is determined whether the danger zone 33 also lies within one of the authorized firing sectors 38 for the instantaneous weapon setting 39. Only if this is the case is the firing authorization given for this firing sector 38.

Alternatively, the danger zone 33 can also be accounted for in the central computer 24 of the monitoring device 20. To this end, it is also necessary for the firing skirmish participant 11 to inform the monitoring device 20 of the type of ammunition it is firing via the data radio connection. The incorporation of the danger zone 33 into the calculation of the authorized firing sectors 38 reduces the sector boundaries $\Theta_{G1}$ and $\Theta_{G2}$ of the firing sectors 38, so the angular width of the authorized firing sectors 38 is more limited.

The calculation of the authorized firing sectors 38 can also include so-called system tolerances, which occur when error tolerances appear in the determination of the position of the skirmish participants 11, 11', for example, and in the determination of the instantaneous weapon setting 39, in the safety device 21.

An authorized firing sector 38 that the central computer 24 has calculated for a firing skirmish participant 11 is always deeper or longer than the range of the projectile to be fired from the weapon 17 of the firing skirmish participant 11. Alternately, it is possible to shorten the shot for the firing skirmish participant 11 by assigning each authorized firing sector 38 of the firing skirmish participant 11 a maximum elevation angle $\phi$, which is transmitted to the processor 32 via the radio receiver 27. The weapon-setting sensor 30 transmits the instantaneous tangential sight or elevation angle $\epsilon(t)$ of the weapon 17 to the processor 32, which compares the preset maximum elevation angle $\phi(t)$ to the instantaneous tangential sight $\epsilon(t)$ of the weapon 17 of the firing skirmish participant 11. If the instantaneous tangential sight is smaller than the preset maximum elevation angle $\phi(t)$, the firing authorization is given. If this is not the case, firing is blocked.

The invention now being fully described, it will be apparent to one of ordinary skill in the art that many changes and modifications can be made thereto without departing from the spirit or scope of the invention as set forth herein.

What is claimed is:

1. A method for assuring safety during firing exercises with live ammunition by mobile skirmish participants practicing under combat conditions in an enclosed practice range that is monitored from a monitoring center, said method comprising the steps of:

continuously determining instantaneous positions of the skirmish participants;

transmitting the determined instantaneous positions to the monitoring center;

in the monitoring center, calculating current, respective authorized firing sectors for the respective firing skirmish participants, taking into account a boundary of the practice range and the transmitted instantaneous positions and movement regions derived therefrom for the skirmish participants;

individually transmitting the authorized firing sectors to the respective firing skirmish participants; and, at each firing skirmish participant, comparing a respective instantaneous weapon setting to the respective authorized firing sector, and providing a firing authorization for a respective firing sector only if the respective instantaneous weapon setting lies within the respective authorized firing sector.

2. The method according to claim 1, wherein said step of calculating includes defining the calculated firing sectors by the respective azimuth angle ($\Theta$) associated with the position of the respective firing skirmish participant.

3. The method according to claim 2, wherein each azimuth angle ($\Theta$) is defined by a lower and an upper north angular boundary ($\Theta_{G1}$, $\Theta_{G2}$).

4. The method according to claim 1, wherein said step of calculating the authorized, current firing sectors for each firing skirmish participant includes determining a danger zone, said danger zone being defined as a spatial expansion in the practice range based on a weapon type of the respective firing skirmish participant and a type of ammunition to be fired with said weapon type.

5. The method according to claim 4, wherein said step of calculating further includes taking additional, possible error tolerances into consideration in the calculation of the authorized firing sectors.

6. The method according to claim 5, wherein the error tolerances taken into consideration include error tolerance in the determination of participant position and weapon setting.

7. The method according to claim 1, further including: determining a danger zone, said danger zone being defined as a spatial expansion in the practice range based on a weapon type of the respective firing skirmish participant and a type of ammunition to be fired with said respective weapon type; and incorporating the determined respective danger zone into the comparison of the respective instantaneous weapon setting to the current authorized firing sector such that firing authorization is only given if the danger zone lies within the authorized firing sector for the respective instantaneous weapon setting.

8. The method according to claim 7, wherein said step of calculating further includes taking additional, possible error tolerances into consideration in the calculation of the authorized firing sectors.

9. The method according to claim 8, wherein the error tolerances taken into consideration include error tolerance in the determination of participant position and weapon setting.

10. The method according to claim 1, wherein said step of calculating includes taking into consideration the positions of stationary objects within the practice range that must be protected.

11. The method according to claim 1, further including assigning times of determination to the positions of the respective skirmish participants; assigning times of calculation to the respective calculated firing sectors, as well as a respective validity period for each calculated firing sector; and allocating respective firing sectors to the respective firing skirmish participants for comparison to the instantaneous weapon setting only if the respective firing sectors' associated validity period encompasses the time when the instantaneous weapon setting was determined.

12. The method according to claim 1, further including using preset criteria to exclude firing sectors selected from the calculated, authorized firing sectors from transmission to the firing skirmish participants.

13. The method according to claim 12, wherein the preset criteria include at least one of the absence of targets, didactic reasons and tactical reasons.

14. The method according to claim 1, further including initiating at least one of a visual and an acoustic display upon the issue of the firing authorization.

15. The method according to claim 1, further including: for each firing skirmish participant, normally maintaining a respective firing trigger in a blocked setting, and deactivating the blocked setting when a firing authorization is given.

16. The method according to claim 1, including transmitting the positions of the skirmish participants to the monitoring center and the calculated, authorized firing sectors from the monitoring center to the firing skirmish participants via a data radio connection between the skirmish participants and the monitoring center.

* * * * *